United States Patent [19]

Chen

[11] Patent Number: 4,828,431

[45] Date of Patent: May 9, 1989

[54] STRENGTHENED PROTECTIVE STRUCTURE

[75] Inventor: Andrie C. Chen, Houston, Tex.

[73] Assignee: Exxon Production Research Company, Houston, Tex.

[21] Appl. No.: 98,437

[22] Filed: Sep. 18, 1987

[51] Int. Cl.[4] ..... E02B 17/00; E02D 21/00

[52] U.S. Cl. ..... 405/217; 405/195; 405/61

[58] Field of Search ..... 405/195, 217, 203, 204, 405/224, 11–13, 269, 61

[56] References Cited

U.S. PATENT DOCUMENTS

| | | | |
|---|---|---|---|
| 3,436,920 | 4/1969 | Blenkarn et al. . | |
| 3,526,096 | 9/1970 | Frein et al. . | |
| 3,675,430 | 7/1972 | Haimila | 405/217 |
| 3,842,607 | 10/1974 | Kelseaux et al. . | |
| 3,990,252 | 11/1976 | Louden . | |
| 4,055,052 | 10/1977 | Metge . | |
| 4,072,017 | 2/1978 | Shiraki | 405/269 X |
| 4,089,183 | 5/1978 | Endo et al. | 405/269 X |
| 4,265,569 | 5/1981 | Gefvert | 405/217 |
| 4,326,822 | 4/1982 | Oshima et al. | 405/217 |
| 4,523,879 | 6/1985 | Finucane et al. | 405/217 |
| 4,575,281 | 3/1986 | Oksulzer | 405/217 |
| 4,583,882 | 4/1986 | Szabo | 405/217 |
| 4,632,604 | 12/1986 | McKelvy | 405/217 |
| 4,692,065 | 9/1987 | Suzuki et al. | 405/217 X |

FOREIGN PATENT DOCUMENTS

| | | | |
|---|---|---|---|
| 1066900 | 11/1979 | Canada | 405/217 |
| 0075013 | 6/1980 | Japan | 405/217 |

OTHER PUBLICATIONS

"Project Mixes Oil and Water", Civil Engineering-/ASCE, Jul. 1985, p. 54.

*Primary Examiner*—Dennis L. Taylor

*Attorney, Agent, or Firm*—Todd N. Hathaway

[57] ABSTRACT

A method and structure for protecting an offshore structure in an arctic body of water from mobile ice, waves, and currents. Soil is dredged from the floor of the body of water, deposited in a berm having a size and shape adapted to protect the offshore structure, and strengthened in place by mixing cement with a portion of the soil in the berm. The space between the berm and the offshore structure is filled with unstrengthened soil fill.

22 Claims, 3 Drawing Sheets

STRENGTHENED PROTECTIVE STRUCTURE

FIELD OF THE INVENTION

The present invention relates to the protection of offshore structures. More particularly, the present invention relates to strengthened soil berms for the protection of offshore structures such as offshore production platforms, man-made islands, and wellheads in arctic environments.

BACKGROUND OF THE INVENTION

The production of petroleum from new reservoirs has led in recent years to operations in frigid offshore environments where large bodies of moving ice are found. These large moving bodies of ice can severely damage offshore structures such as production platforms and underwater pipelines which lie in their paths.

An example of such an area is off the north coast of Alaska in the Beaufort Sea. With the onset of winter, the sea water near the coastline begins to freeze over. This results in the formation of a relatively smooth and continuous sheet of ice called fast ice which extends seaward from the shore to points which lie over water approximately 60 feet deep. The name fast ice implies that this sheet of ice is held fast to the land and does not move. Fast ice can, however, be moved by natural forces such as currents, tides, and temperature changes, with the rate of movement being generally dependent on the thickness of the ice.

When set in motion, fast ice poses a threat to offshore operations. When the ice comes into direct contact with an offshore drilling structure such as a production platform, large forces may develop. These forces cause the ice sheet to break and pile up directly against the offshore structure, forming a rubble field. As the rubble field grows and continues to be pressed against the structure, the forces can increase until the structure is seriously damaged.

Although it is subject to movement, fast ice is relatively stable during the winter. However, the fast ice sheet breaks up during the summer, resulting in the formation of many individual floating bodies of ice which are free to move about under the influence of winds and currents. These moving bodies of ice pose another threat to offshore operations.

Seaward of the fast ice zone is pack ice. Unlike fast ice, pack ice is discontinuous, rugged, and highly mobile. As pack ice moves, local areas of tension and compression develop, causing the ice to break and pile up. As a result, open leads and pressure ridges are formed.

Pressure ridges form in areas of pack ice which experience large compressive forces. The ice breaks and piles up, concentrating large masses of ice into relatively small areas. Pressure ridges extend well above and below the surrounding ice, and some are so large that they are able to survive the summer and become multiyear ice features.

During the winter season, many pressure ridges are embedded in the pack ice and move along with it, threatening any structure in their path. During the summer, pressure ridges can be blown toward shore, where they threaten structures which lie in shallow waters.

Finally, other moving bodies of ice such as glacial icebergs and floebergs also pose serious threats to offshore operations.

Numerous approaches have been suggested for protecting offshore structures from large moving bodies of ice. For example, U.S. Pat. No. 3,436,920 (Blenkarn et al.) discloses the use of a fence-like barrier which is erected around an offshore structure. Methods such as this have serious drawbacks due to both the time and expense involved in their construction and the expense of the materials. The general lack of availability of construction materials in arctic regions usually means they have to be transported great distances. The structures must then be built, placed in position and anchored to the sea floor.

U.S. Pat. No. 4,523,879 (Finucane et al.) avoids many of the drawbacks associated with the use of barriers which must be assembled from materials not readily available in arctic regions. It calls for the use of ice made by spraying water drawn from the surrounding sea outward and into the air about the offshore structure to form a spray ice barrier about the structure. Although this approach is highly effective for protecting temporary exploration drilling structures, it has its drawbacks where year-round protection of permanent production structures is required. Spray ice barriers tend to deteriorate during summer due to warm ambient temperatures, and due to wave and current erosion as well, and may disappear before the end of the summer. Other ice structures which have been suggested, such as the ice rubble generator - a steel frame or sunken barge designed to trigger pileup of moving ice - tend to share this drawback to varying extents.

More permanent protective structures may be formed using gravel or soil. U.S. Pat. No. 3,990,252 (Louden) describes (1) admixing a slurry of dredgings from the ocean floor with hydraulic cement and soluble alkali silicate, and then (2) placing this slurry between forms (or in sandbags or cans) to form an artificial island perimeter. Although this approach both avoids the warm weather deterioration drawbacks associated with the ice barrier approaches and utilizes readily available seafloor dredgings, it does require the construction of forms (or the use of sandbags or cans) and consequently suffers from the material supply and expense drawbacks described above.

Some protective structures have been constructed using soil materials without forms, bags, or cans. The Seawater Treatment Plant installed by the Prudhoe Bay unit at a 13 foot water depth location is protected on three sides by a U-shaped gravel berm which is contiguous with the structure and which has an 18 foot freeboard. Good quality gravel and well-controlled construction techniques were used to achieve the berm strength required to resist expected ice forces. In order to obtain the correct quality materials, however, the gravel had to be brought to the site from an onshore gravel pit—an approach which would be very expensive for a large structure further offshore. Locally dredged materials do not generally provide adequate strength for such an approach. Even with the superior quality materials used at the Seawater Treatment Plant site, some significant maintenance has been required to repair eroded parts of the berm, especially in its above-water portion. In addition, it is readily apparent that an excessive amount of unstrengthened material would be necessary to construct such protective berm in deeper water. Furthermore, as the Seawater Treatment Plant berm is contiguous with the structure, harmful ice forces may be readily transmitted through the berm to the structure. The Seawater Treatment Plant avoids large moving bodies of ice capable of imparting serious ice forces largely by virtue of its location in shallow water.

In addition to the ice forces described above, unprotected offshore structures are also subject to other natural damaging forces, including the large waves and strong currents frequently encountered in deep water locations.

Consequently, there is still needed an economically constructs means for protecting offshore structures from moving bodies of ice and other natural forces. Such means would make it much more economical to produce oil and gas from offshore reservoirs in the arctic regions.

SUMMARY OF THE INVENTION

Briefly, the present invention involves means for protecting offshore structures located in frigid waters from moving ice and other forces such as waves and currents. A soil berm is constructed which has its base grounded on the sea floor. The berm is constructed by dredging soil from the sea floor and depositing it in a shape and size adapted to protect the offshore structure, at a location which is laterally offset from the structure. The berm is strengthened by mixing cement with at least a portion of the soil therein. The space between the berm and the offshore structure is filled with unstrengthened soil fill. The strengthening can be by the Deep Cement Mixing method.

DESCRIPTION OF THE PREFERRED EMBODIMENTS

The present invention involves the construction of a strengthened soil berm designed to protect offshore structures from moving bodies of ice and other natural forces such as waves and currents. The details of a preferred embodiment of the present invention will be described below.

Figure 1:
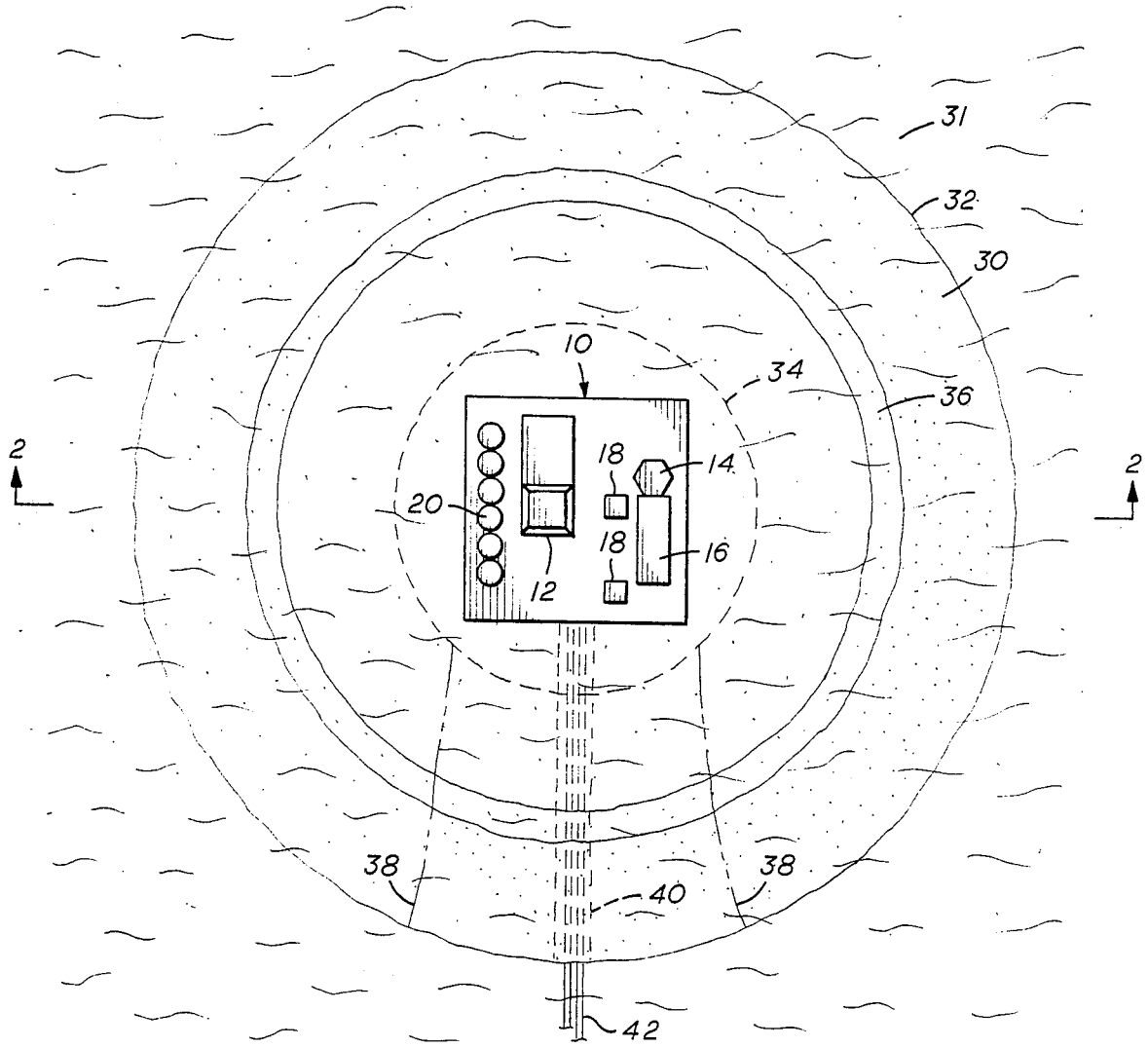
FIG. 1 is a plan view of a strengthened soil structure protecting an offshore structure in accordance with the present invention.

With reference to FIG. 1, a plan view of a structure in accordance with the present invention can be seen. Production platform 10 is positioned at a desired offshore well location. By way of illustration, production platform 10 is shown with equipment normally associated with offshore petroleum production operations, such as derrick 12, helicopter pad 14, crew quarters 16, ballast control stations 18, and storage tanks 20. Production platform 10 is preferably resting on or fixed to the underlying sea floor.

Surrounding production platform 10 is protective strengthened soil berm 30 which is constructed in accordance with the present invention. Strengthened soil berm 30 is preferably formed by dredging soil from the floor 31 of the surrounding body of water and depositing the soil a laterally offset distance from the desired location of production platform 10 in a berm having a size and shape adapted to protect production platform 10. The term "soil" as used in this description and the appended claims includes any suitable relatively unconsolidated earth or ground material, including mud, sand, and gravel, whether obtained from the sea floor or onshore. When deposited, the soil settles to a natural angle of repose and, with respect to the desired location of production platform 10, the berm has an outer boundary 32 and an inner boundary 34. Strengthened soil berm 30 overlies sea floor 31. The area of sea floor 31 which lies within the inner boundary 34 of berm 30, and which corresponds to the desired location of production platform 10, is preferably substantially surrounded or enclosed by berm 30. Berm 30 is thus preferably doughnut-shaped in this embodiment.

With further reference to FIG. 1, it will be noted that berm 30 is preferably constructed so that the area of sea floor 31 lying within inner boundary 34 of berm 30 is large enough to receive production platform 10 without production platform 10 being in contact with inner boundary 34. In other words, when installed at its desired location, production platform 10 is substantially free from contact with protective berm 30. This arrangement avoids the problem of damaging ice forces being transmitted through the protective berm to the production platform.

As described above, protective berm 30 preferably substantially surrounds the desired location of production platform 10. Depending on the time and mode of installation of production platform 10, it may be desired that an opening having edges 38 be initially left in protective berm 30 to allow for the installation of production platform 10. In this event, the opening should preferably have a size and shape adapted to permit the lateral passage of production platform 10 therethrough. The actual method of moving production platform 10 from the surrounding sea through protective berm 30 to its desired location will vary with the type of production platform involved. Some bottom founded production platform structures float under their own buoyancy until they are ballasted at their desired location. Other types of structures may need to be carried by barges or other means to their desired location. The opening through protective berm 30 will thus need to be tailored to accommodate the lateral passage of the particular structure to be installed at the desired location therein. Furthermore, the location of the opening in berm 30 should be selected so as to afford production platform 10 and any support craft the maximum possible amount of protection during the installation procedure. Since such installation operations are most likely to be performed during the summer, and since, as described above, the moving ice bodies may move shoreward (i.e. southward) in arctic regions during the summer, it is apparent that the opening should generally be positioned in the south side of berm 30 so that the remainder of berm 30 can protect production platform 10 and its support craft from large bodies of ice approaching from the north during installation operations.

Once production platform 10 has been installed in its desired location, the opening in berm 30 can be filled in with a soil barrier in a shape and size substantially continuous with the remainder of the berm.

Once the soil has been deposited and shaped as described above to form protective berm 30, protective berm 30 can be strengthened by mixing cement with at least a portion of the soil therein. This in-place mixing may be accomplished using a variety of techniques. As will be described in more detail below with reference to FIG. 4, the strengthening of protective berm 30 in the preferred embodiment is preferably performed by means of the Deep Cement Mixing (DCM) method. Basically, DCM involves injecting cement slurry into the soil from a barge through long slurry pipes penetrating the soil and mixing the cement and soil in place with mixing heads attached to the lower ends of rotating mixing shafts which accompany the slurry pipes. DCM, as further described below, is proven technology which provides high quality in place soil strengthening. In many applications, the DCM method may use ordinary Portland cement. Although this embodiment of the present method is preferably practiced with DCM, other soil strengthening methods such as Deep Lime Mixing and Deep Chemical Mixing are known to those skilled in the art and their use to strengthen the protective berm is within the scope of the present invention. The term "cement" is used in this description and in the appended claims to represent all such soil-strengthening or binding substances.

Strengthening soil berm 30 with DCM serves a number of desirable purposes in the present invention. A primary advantage of strengthening the berm with DCM is that it permits the berm to be constructed of almost any soil material, including virtually any seabed material. The berm can consequently be constructed using locally dredged seabed material which itself would not be strong enough to resist environmental forces if it was not strengthened. This approach thus avoids many of the supply and expense problems associated with constructing protective structures with materials brought in from outside the local area.

As another advantage, the DCM strengthened berm is, of course, much more able to resist ice forces than an unstrengthened mound of the same size. Consequently, far less soil needs to be dredged for the strengthened protective structure than for an unstrengthened one.

A further advantage of strengthening berm 30 with DCM is that the soil in berm 30 is strengthened in place, after it has been deposited in its desired location and configuration. By strengthening the mound in place, rather than by previously mixing the soil and cement to form a cement-soil slurry and then depositing the cement-soil slurry to form a protective structure, the method of the present invention eliminates the need for expensive, difficult to construct forms (or sandbags or cans) to retain the slurry.

Yet another advantage of the DCM strengthened berm is its resistance to erosion. As noted above, even structures constructed of high grade materials, such as the Seawater Treatment Plant berm at Prudhoe Bay, suffer from erosion if unstrengthened. By strengthening the berm with DCM, the need for revetments, netting, or other slope erosion protection, or for expensive erosion maintenance and repair, is eliminated.

In the preferred embodiment of the present invention, the major portion of the berm is strengthened to maximize the advantages detailed above and afford the greatest protection to the offshore structure. It will likely be desirable, however, that at least one segment of the berm remain unstrengthened. With further reference to FIG. 1, it is seen that a segment or corridor 40 through protective berm 30 is left unstrengthened for the installation and maintenance of pipelines 42 leading from production platform 10. Pipelines 42 may conduct oil and gas produced at production platform 10 to a variety of locations, including for example, shore based storage facilities. Corridor 40, being unstrengthened, permits pipelines 42 to be set into the soil of berm 30, in order that they may be laid and supported along sea floor 31 and not be exposed to the ice forces when they are in place, and further permits the pipelines to be withdrawn through the unstrengthened soil when maintenance or replacement is required.

Figure 2:
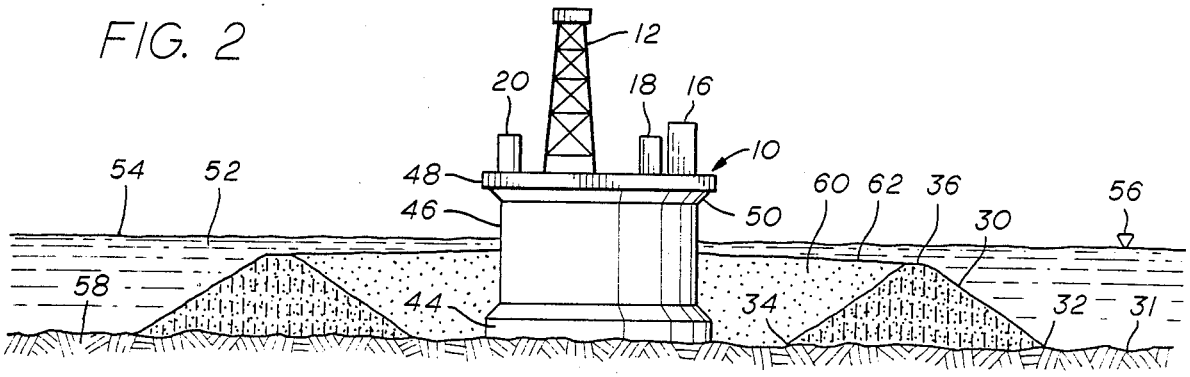
FIG. 2 is a cross section of the structure of FIG. 1.

Referring now to FIG. 2, a cross section of a completed protective structure of the present invention taken along line 2—2 of FIG. 1 can be seen. Strengthened protective berm 30 is shown substantially surrounding production platform 10. The type of production platform illustrated is a bottom-founded concrete structure having a base 44, a support mid-section 46, and an upper deck 48. It will be noted that the underside of deck 48 is provided with an angled skirt 50 about its perimeter to deflect outwardly any ice accumulating about mid-section 46. Base 44 of production platform 10 rests on the floor 31 of body of water 52. Body of water 52 also has a surface 54 which has a mean low water level 56 about which it fluctuates during its natural cycles. Beneath the floor 31 of body of water 52 is soil material 58 which is used to construct protective berm 30 as described above.

In the embodiment illustrated, the top of berm 30 forms a shelf 36 which is a predetermined level or depth below water level 56. As will be described in more detail below, the depth below water level 56 at which shelf 36 is located in this embodiment is selected to permit the passage of soil strengthening barges over the top of the berm, and also to permit the passage of support vessels over the top of the berm as they come and go from production platform 10. A shelf sufficiently deep to permit such vessels to pass over it will also ordinarily permit certain minor ice features to pass over it as well. As used in this description and the appended claims, the term "minor ice features" is intended to include ice features having relatively shallow drafts, including fast ice and pack ice (except for pressure ridges). The depth of shelf 36 is selected, however, to be shallow enough to block the passage of certain severe ice features which have deeper drafts than the minor ice features. As used in this description and in the appended claims, the term "severe features" is intended to include pressure ridges and multiyear ice features, plus other large moving ice bodies such as glacial icebergs and floebergs. The impact of the more severe ice features is absorbed by protective berm 30.

With further reference to FIG. 2, it can be seen that, in the embodiment of the present invention illustrated, the space between protective berm 30 and production platform 10 is filled with soil 60. Soil 60, unlike that in protective berm 30, however, remains unstrengthened; preferably, it is simply dredged from sea floor 31 and deposited between berm 30 and production platform 10. Filling the space between protective berm 30 and production platform 10 with unstrengthened soil 60 prevents this region from becoming filled and packed with ice which has impacted with and broken up around the platform and berm. Relatively rigid packed ice filling this region may transmit harmful impact loads or shocks from the berm to the production platform. Unstrengthened soil 60, being relatively soft and deformable by contrast, does not readily transmit such loads or shocks. Consequently, loading and shocks received by protective berm 30 from moving ice bodies are not transmitted to production platform 10, which thus does not require the expensive strengthening which would be necessary to withstand such loading and shocks.

Unstrengthened soil 60 furthermore has an upper surface or top 62 which is preferably formed at a depth below water level 56 which is selected to permit the passage of vessels thereover, as described above. The depth and the contour of unstrengthened soil top 62 are also preferably selected to trigger ice rubble pileup of ice moving over it. As described above, shelf 36 is located at a depth below water level 56 which allows certain minor ice features to pass over it. In early winter, these minor ice features pass over shelf 36 and form ice rubble pileup over the top 62 of unstrengthened soil 60 and around production platform 10. This ice rubble buildup serves as additional protection against potential severe late winter ice events.

In addition to providing production platform 10 with protection from moving ice bodies, it will be understood that strengthened protective berm 30 also provides production platform 10 with protection from both deepwater ocean currents and large waves, the latter which cannot pass over the top of protective berm 30 without breaking and losing their force.

Figure 3:
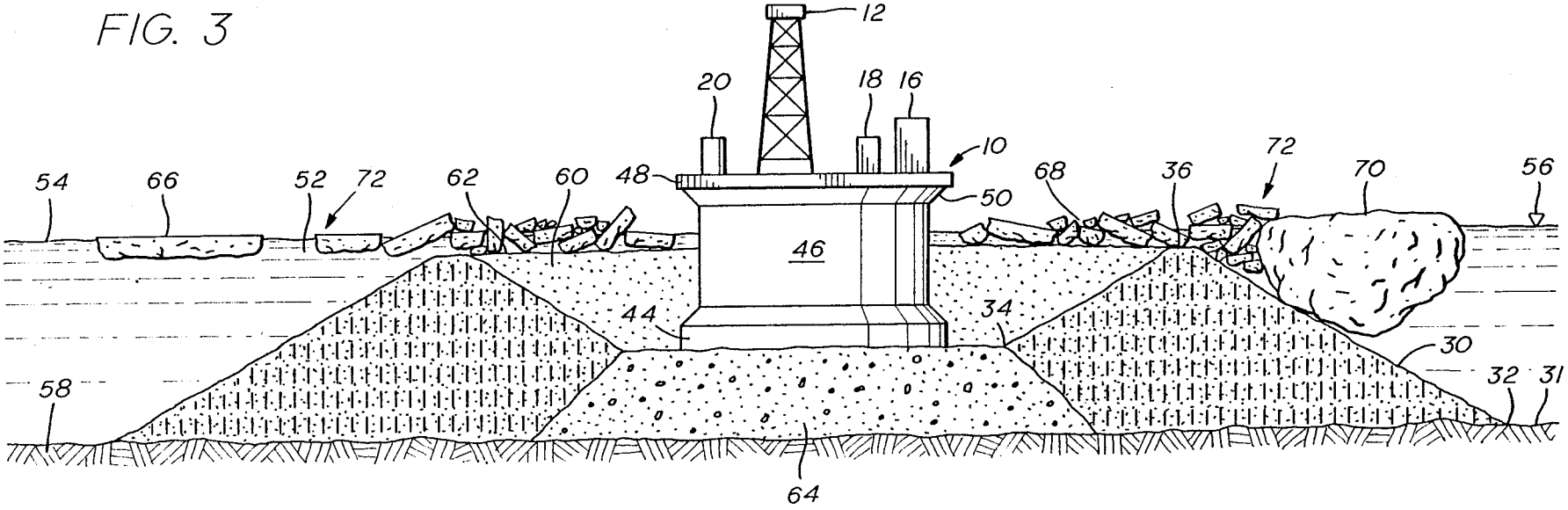
FIG. 3 is a cross section showing an alternative embodiment of the structure of the present invention which is adapted for use in deep water.

With reference now to FIG. 3, a cross-sectional view of an alternative embodiment of the structure constructed in accordance with the present invention can be seen. The embodiment of the present invention illustrated in FIG. 3 is adapted for use in relatively deepwater areas. A central elevating foundation 64 is constructed of suitable material, such as either good quality gravel or locally dredged soil strengthened as described above, on sea floor 31. Foundation 64 is constructed to be of adequate strength to support production platform 10 when the platform is subjected to the design ice loads. Foundation 64 is also constructed with sufficient height to support production platform 10 at the desired elevation relative to water level 56. In the embodiment of the present invention illustrated in FIG. 3, foundation 64 is formed prior to the deposition and hardening of the surrounding protective berm 30. It may be desired in some applications, however, that most of protective berm 30 be formed prior to the formation of central foundation 64.

Once central foundation 64 is completed, production platform 10 may be installed with its base 44 on top of it, and protective berm 30 completed and hardened as described above. Unstrengthened soil 60 may then be deposited between protective berm 30 and production platform 10.

As described above, unstrengthened soil top 62 has a depth selected to permit certain vessels to pass thereover, and further has a depth and a contour selected to trigger ice rubble pileup of minor ice features passing over it. With reference to FIG. 3, soil top 62 is shown having a contour which slopes upward towards production platform 10, resulting in progressively shallower water depths nearer the platform. With further reference to FIG. 3, a minor ice feature 66 is shown approaching production platform 10, which is surrounded by protective berm 30 and unstrengthened soil 60. Once minor ice features such as ice feature 66 pass over the top of protective berm 30, they ground on the top 62 of unstrengthened soil 60, which causes them to collide, break up, and form ice rubble pileup 68. Some such minor ice features, or possibly ice rubble pileup 68, may eventually impact support mid-section 46 of production platform 10, which absorbs the impact, transmitting a portion thereof to central foundation 64. Should the ice rubble pileup extend vertically about support mid-section 46, it will be deflected away from deck 48 by skirt 50.

As mentioned above, ice rubble pileup 68 serves as additional protection for production platform 10 from potential severe late winter ice events. Such a severe ice event appears in FIG. 3 in the form of multiyear pressure ridge 70. As can be seen in FIG. 3, the major force of the impact of multiyear pressure ridge 70 is absorbed by strengthened protective berm 30. Some portion of the force of the impact, however, is absorbed by edge 72 of ice rubble pileup 68, which is crushed by the impact of multiyear pressure ridge 70 and cushions the force of its blow against protective berm 30. Since protective berm 30 is strengthened as described above, its own ability to withstand the impact of such severe ice events far exceeds that of an unstrengthened mound of the same size.

Figure 4A:
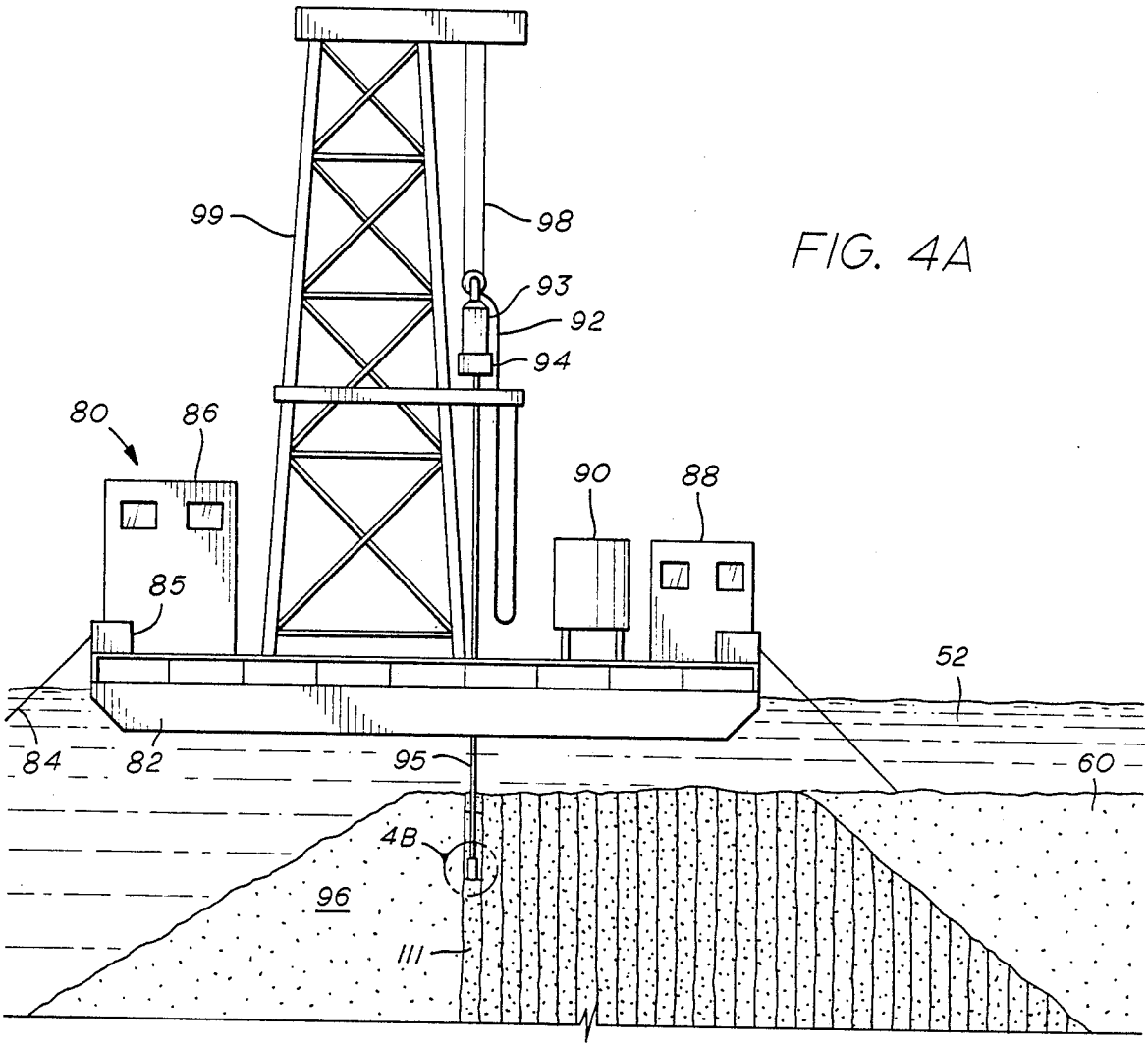
FIG. 4A is a plan view which shows a Deep Cement Mixing barge which can be used to strengthen the structure according to the present invention.

With reference now to FIG. 4, the Deep Cement Mixing soil strengthening method referred to above will be described in more detail. As previously mentioned, the DCM method is a proven approach which produces high strength, consistent quality soil strengthening. It has been successfully utilized in Japan for strengthening river beds and harbor bottoms, and is often conducted from a floating barge. With reference to FIG. 4A, a typical DCM barge is indicated generally by reference numeral 80.

Barge 80 has a hull 82 floating on body of water 52 and held in position by anchor cables 84 attached to anchors (not shown) on the sea floor The position of barge 80 may be adjusted by heaving in on, or paying out on, anchor cables 84 with winches 85. Barge 80 also has a control station 86 and a mixing plant 88 which mixes cement stored in hoppers 90 to form a cement slurry. The cement slurry is supplied through flexible pipes 92 to DCM machine 93. DCM machine 93 is equipped with a hydraulic drive motor 94 which rotates mixing shafts 95. Mixing shafts 95 extend downwardly through hull 82 and into soil 96 which is to be strengthened. DCM machine 93 also supplies cement slurry to slurry pipes which also extend downwardly through hull 82 and into soil 96 in company with mixing shafts 95. DCM machine 93 is supported from vertical pulley assembly 98 so that it can be displaced in a vertical direction, and thereby move mixing shafts 95 and the slurry pipes together in a vertical direction. Vertical pulley assembly 98 is in turn supported by tower 99.

Figure 4B:
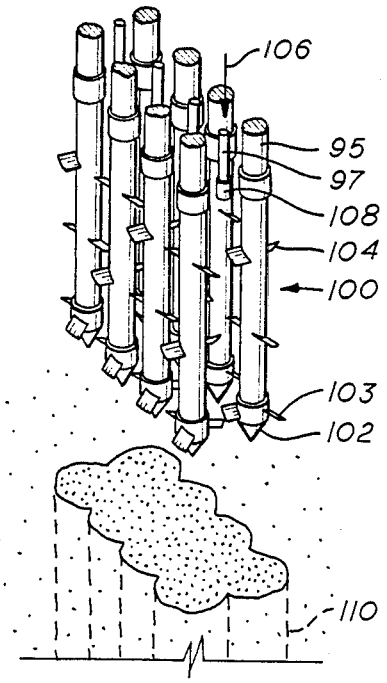
FIG. 4B is a perspective view which shows the lower mixing head assemblies of the Deep Cement Mixing barge of FIG. 4A.

With reference now to FIG. 4B, the lower end area of mixing shafts 95 and the slurry pipes will be described in more detail. The lower end of mixing shafts 95 comprises a set of mixing head assemblies as indicated generally by reference numeral 100. Each mixing shaft is equipped with a mixing head assembly. Each mixing head assembly comprises an excavating point 102 with excavating blades 103, and a set of mixing blades 104 above the excavating blades.

DCM machine 93 is lowered from tower 99 using vertical pulley assembly 98 until the mixing head assemblies begin to penetrate the soft soil. Hydraulic motor 94 is then actuated to rotate mixing shafts 95 in the desired direction so that excavating blades 103 act to bore into the soil. When the desired depth in the soil is reached, the lowering is stopped and the rotation of mixing shafts 95 is reversed for withdrawal. As the shafts are withdrawn, cement slurry is fed downward through the slurry pipes 97 in the direction indicated by arrow 106 and discharged into the soil through nozzles 108. The cement slurry is mixed with the soil by mixing blades 104. As the mixing shafts are withdrawn upwardly, they leave behind a type of soil-cement pile or column 110. These columns can provide the improved soil with a maximum unconfined compressive strength in excess of 100 kips per square foot; a strength improvement on the order of 50 to 100 times that of the natural, unstrengthened soil. Through careful positioning of the DCM barge, strengthened columns 110 can be overlapped to form a variety of strengthening patterns. With reference to FIG. 4A, for example, the columns have been overlapped to form walls 111. Examples of alternative patterns include pile, cell, and block type patterns, each providing a varying amount of strengthening of the total soil area. A pattern suitable for strengthening the soil in the protective berm of the present invention may readily be determined by those skilled in the pertinent art. Furthermore, it will be obvious to those skilled in the art that it may be desirable in certain applications of the present invention to use alternative in-place soil strengthening methods, such as the aforementioned Deep Lime Mixing or Deep Chemical Mixing methods, in place of the DCM method.

Inasmuch as the present invention is subject to many variations, modifications, and changes in detail, it is intended that all subject matter discussed above or shown in accompanying drawings be interpreted as illustrative and not in a limiting sense. Such modifications and variations are included within the scope of this invention as defined by the following claims.

What is claimed is:

1. A method for protecting an offshore structure in a body of water from the forces of ice moving in said body of water, comprising the steps of:

forming a soil berm at a location which is laterally offset from said offshore structure, said soil berm substantially surrounding said offshore structure and having a size and shape adapted to block the passage of said ice;

strengthening said soil berm in place by mixing cement with at least a portion of the soil therein, so that said berm withstands the impact of said ice; and filling the space between said soil berm and said offshore structure with deformable unstrengthened soil fill, so as to substantially prevent the transmission of the forces of said impact of said ice from said berm to said offshore structure.

2. The method of claim 1, wherein the step of forming said soil berm further comprises the steps of:

dredging soil from the floor of said body of water; and depositing said soil in a berm on the floor of said body of water at a location which is laterally offset from said offshore structure.

3. The method of claim 2, wherein the top of said soil berm forms a shelf of a depth below the level of said body of water which is selected to permit the passage thereover of vessels having a predetermined draft in said body of water.

4. The method of claim 3, wherein said depth of said shelf below said level of said body of water is further selected to prevent the passage thereover of severe ice features having a predetermined draft in said body of water.

5. The method of claim 1, further comprising the step of leaving at least one segment of said berm unstrengthened for a pipeline corridor.

6. The method of claim 4, wherein said step of filling the space between said soil berm and said offshore structure further comprises filling said space with unstrengthened soil fill to a depth below said level of said body of water which is selected to permit the passage thereover of vessels having a predetermined draft in said body of water.

7. The method of claim 6, wherein said step of filling the space between said soil berm and said offshore structure further comprises filling said space with unstrengthened soil fill having an upper surface which slopes upward from said berm towards said offshore structure so as to provide progressively shallower water depths nearer said offshore structure, said water depths nearer said offshore structure being sufficiently shallow to cause minor ice features having a sufficiently shallow draft to permit their passage over said shelf on said berm to ground on said soil fill.

8. A method for protecting an offshore structure in a body of water from the forces of ice moving in said body of water, comprising the steps of:

dredging soil from the floor of said body of water;

depositing said soil on the floor of said body of water in a berm substantially surrounding a portion of said floor of said body of water, said portion of said floor of said body of water being sufficient in size to receive said offshore structure, said berm having a size and shape adapted to block the passage of said ice, said berm further having at least one opening therein sized to permit the lateral passage of said offshore structure therethrough;

strengthening said berm by mixing cement with at least a portion of the soil therein so that said berm withstands the impact of said ice;

transporting said offshore structure laterally through said opening in said berm;

mounting said offshore sturcture on said portion of said floor of said body of water substantially surrounded by said berm; and filling the space between said berm and said offshore structure with deformable unstrengthened soil fill so as to substantially prevent the transmission of the forces of said impact of said ice from said berm to said offshore structure.

9. The method of claim 8, further comprising the subsequent steps of:

dredging soil from the floor of said body of water;

depositing said soil in a barrier in said opening in said berm, said barrier being substantially continuous with said berm; and strengthening said barrier in place by mixing cement with at least a portion of the soil therein so that said barrier withstands the impact of said ice.

10. The method of claim 8 further comprising the step of forming an elevating foundation for said offshore structure on said portion of said floor of said body of water substantially surrounded by said berm.

11. A structure for protecting an offshore structure in a body of water from the forces of severe ice features moving in said body of water, said protective structure comprising:

a soil berm substantially surrounding said offshore structure, said berm being strengthened by cement mixed in place with at least a portion of the soil therein so that said berm withstands the impact of said severe ice feactures, said berm further having a top forming a shelf at a depth below the level of said body of water, said depth of said shelf being selected to permit the passage thereover of both vessels and minor ice features having sufficiently shallow drafts in said body of water, and to prevent the passage thereover of said severe ice features having sufficiently deep drafts in said body of water; and deformable unstrengthened soil fill in the space between said berm and said offshore sturcture for substatially preventing the transmission of the force of said impact of said severe ice features from said berm to said offshore structure, said unstrenghened soil fill having a top at a depth below the level of said body of water which is selected to permit the passage thereover of said vessels, said top of said unstrengthened soil fill further having a depth and contour selected to trigger rubble pileup of said minor ice features which pass over said berm.

12. A structure for portecting an offshore structure in a body of water from the forces of ice moving in said body of water, comprising:

a strengthened soil berm spaced apart from and substantially surrounding said offshore structure for withstanding the impact of said moving ice; and deformable unstrengthened soil fill in the space between said strengthened soil berm and said offshore structure for substantially preventing the transmission of the forces of said impact of said moving ice from said strengthened soil berm to said offshore structure, wherein said strengthened soil berm is substantially completely submerged and has a top at a depth below the level of said body of water such that said berm blocks the passage thereover of severe ice features while permitting the passage therover of minor ice features.

13. The structure of claim 12, wherein said soil berm is formed from soil dredged from the floor of said body of water.

14. The structure of claim 13, wherein said strengthened soil berm is a berm strengthened by deep cement mixing.

15. The structure of claim 12, wherein said deformable unstrengthened soil fill is substantially completely submerged.

16. The structure of claim 15, wherein said deformable unstrengthened soil fill has an upper surface which slopes upward form said berm towards said offshore structure so as to provide progressively shallower water depths nearer said offshore structure, said water depths nearer said offshore structure being sufficiently shallow to cause grounding of said minor ice features thereon.

17. The structure of claim 14, wherein said strengthened soil berm includes at least one unstrengthened segment for the installation of pipelines therethrough.

18. A structure for protecting an offshore structure in a body of water from the forces of ice moving in said body of water, comprising:

a strengthened soil berm spaced apart from and substantially surrounding said offshore structure for withstanding the impact of said moving ice, said berm having a top at a depth below the level of said body of water such that said berm blocks the passage thereover of severe ice features while permitting the passage thereover of minor ice features; and deformable unstrengthened soil fill in the space between said strengthened soil berm and said offshore structure for preventing the transmission of the forces of said impact of said moving ice from said strengthened soil berm to said offshore structure, said unstrengthened soil fill further having an upper suface which is substantially completely submerged and which slopes upwardly from said berm towards said offshore structure so as to provide progressively shallower water depths nearer said offshore structure, said water depths nearer said structure being sufficiently shallow to cause said minor ice features to ground on said soil fill.

19. A method for protecting an offshore structure in a body of water from the forces of ice approaching generally from a particular direction in said body of water, comprising the steps of:

forming a strengthened soil berm for withstanding the impact of said moving ice, said strengthened soil berm having a size and shape adapted to block the passage of severe ice features and substantially surrounding a portion of the floor of said body of water sufficient in size to receive said offshore structure, said strengthened soil berm having an opening therein opposite said direction of approach of said ice, said opening further being sized to permit the lateral passage therethrough of said offshore structure;

transporting said offshore structure laterally through said opening in said berm;

mounting said offshore structure to said portion of said floor of said body of water substantially surrounded by said berm; and filling the space between said berm and said offshore structure with deformable unstrengthened soil fill for preventing the transmission of the force of said impact of said ice from said berm to said offshore structure.

20. A method for protecting an offshore structure in a body of water from the forces of ice moving in said body of water, comprising the step of:

forming a strengthened soil berm spaced apart from and substantially surrounding said offshore structure for withstanding the impact of said moving ice;

filling the space between said strengthened soil berm and said offshore structure with deformable unstrengthened soil fill for preventing the transmission of the forces of said impact of said moving ice from said strengthened soil berm to said offshore structure;

and wherein the step of forming said strengthened soil berm further comprises the step of:

dredging soil from the floor of said body of water;

depositing said soil in a berm having a size and shape adapted to block the passage of said ice;

and mixing cement with at least a portion of the soil therein.

21. The method of claim 20, wherein said strengthened soil berm is substantially completely submerged and has a top at a depth below the level of said body of water such that said berm blocks the passage thereover of severe ice features while permitting the passage thereover of minor ice features.

22. The method of claim 21, wherein said deformable unstrengthened soil fill has a substantially completely submerged top which sloped upward from said berm towards said offshore sturcture so as to provide progressively shallower water depths nearer said offshore structure, said water depths nearer said offshore structure being sufficiently shallow to cause said minor ice features to ground on said fill.

* * * * *